US006872104B2

(12) United States Patent
Sun

(10) Patent No.: US 6,872,104 B2
(45) Date of Patent: Mar. 29, 2005

(54) ELECTRICAL CONNECTOR FOR INTERCONNECTING A CIRCUIT BOARD AND A VIBRATION MODULE IN AN ELECTRONIC APPARATUS

(75) Inventor: Chin-Kai Sun, Pan-Chiao (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/436,367

(22) Filed: May 13, 2003

(65) Prior Publication Data

US 2004/0023532 A1 Feb. 5, 2004

(30) Foreign Application Priority Data

May 22, 2002 (TW) ..... 91207361 U

(51) Int. Cl.[7] ..... H01R 4/48
(52) U.S. Cl. ..... 439/862; 439/374
(58) Field of Search ..... 439/862, 382, 439/374; 310/81

(56) References Cited

U.S. PATENT DOCUMENTS

| | | | | | |
|---|---|---|---|---|---|
| 5,688,149 | A | * | 11/1997 | Aihara | 439/733.1 |
| 5,943,214 | A | * | 8/1999 | Sato et al. | 361/752 |
| 5,980,323 | A | * | 11/1999 | Bricaud et al. | 439/630 |
| 6,231,394 | B1 | * | 5/2001 | Schnell et al. | 439/630 |
| 6,315,621 | B1 | * | 11/2001 | Natori et al. | 439/862 |
| 6,398,598 | B2 | * | 6/2002 | Masumoto | 439/862 |
| 6,740,999 | B1 | * | 5/2004 | Segawa | 310/81 |

* cited by examiner

*Primary Examiner*—Hae Moon Hyeon
(74) *Attorney, Agent, or Firm*—Ladas & Parry LLP

(57) ABSTRACT

An electrical connector includes an integrally formed conductive terminal having a first contact portion, a second contact portion, and a bent retaining portion with an upper end connected to the first contact portion and a lower end disposed below the upper end and connected to the second contact portion. An electronic apparatus incorporating the electrical connector is also disclosed.

25 Claims, 5 Drawing Sheets

ELECTRICAL CONNECTOR FOR INTERCONNECTING A CIRCUIT BOARD AND A VIBRATION MODULE IN AN ELECTRONIC APPARATUS

CROSS-REFERENCE TO RELATED APPLICATION

This application claims priority of Taiwanese application No. 091207361, filed on May 22, 2002.

BACKGROUND OF THE INVENTION

1. Field of the Invention

The invention relates to an electrical connector, more particularly to an electrical connector for interconnecting a circuit board and a vibration module in an electronic apparatus.

2. Description of the Related Art

A vibration module is used to generate vibrations as an alternative in notifying a mobile phone user of the presence of an incoming call. FIGS. 1 and 2 show two conventional methods of mounting a vibration module 10 in a mobile phone. The vibration module 10 has a rubber sleeve 11 sleeved thereon, and is mounted fixedly in a mobile phone housing 12. A resilient plate 13 or a conductive wire 14 is used to interconnect electrically the vibration module 10 and a circuit board 15 that is disposed above the vibration module 10 such that vibrations can be generated in the event of an incoming call.

However, when electrical connection between the circuit board 15 and the vibration module 10 is established with the use of the resilient plate 13, as shown in FIG. 1, the contact between the circuit board 15 and the resilient plate 13 is adversely affected by the quality of the assembly process and deformation of the mobile phone housing 12. Furthermore, because the circuit board 15 presses against the resilient plate 13, the contact point between the circuit board 15 and the resilient plate 13 will shift according to the pressure applied by the circuit board 15 on the resilient plate 13. Thus, to ensure proper contract, a relatively large area must be allotted on the circuit board 15 for establishing contact with the resilient plate 13, which is a waste of the limited board space.

Moreover, when electrical connection between the circuit board 15 and the vibration module 10 is established with the use of the conductive wire 14, as shown in FIG. 2, large amounts of time and labor are needed to properly install the conductive wire 14, thus resulting in a bottleneck in the assembly process.

SUMMARY OF THE INVENTION

Therefore, the object of the present invention is to provide an electrical connector that can overcome the aforesaid drawbacks of the prior art.

According to one aspect of the present invention, an electrical connector comprises an integrally formed conductive terminal having a first contact portion, a second contact portion, and a bent retaining portion with an upper end and a lower end disposed below the upper end. The upper end of the retaining portion is connected to the first contact portion. The lower end of the retaining portion is connected to the second contact portion.

According to another aspect of the present invention, an electronic apparatus comprises a circuit board, a vibration module disposed under the circuit board, and an electrical connector disposed under the circuit board and adjacent to the vibration module. The electrical connector includes an integrally formed conductive terminal having a first contact portion to establish electrical contact with the circuit board, a second contact portion to establish electrical contact with the vibration module, and a bent retaining portion with an upper end and a lower end disposed below the upper end. The upper end of the retaining portion is connected to the first contact portion. The lower end of the retaining portion is connected to the second contact portion.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
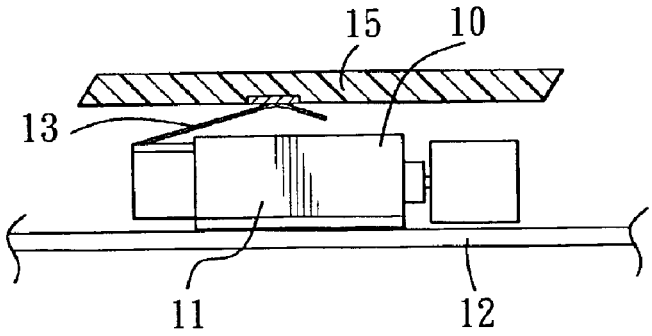
FIG. 1 PRIOR ART
FIG. 1 is a schematic view illustrating a conventional method of making electrical connection between a circuit board and a vibration module with the use of a resilient plate.
Figure 2:
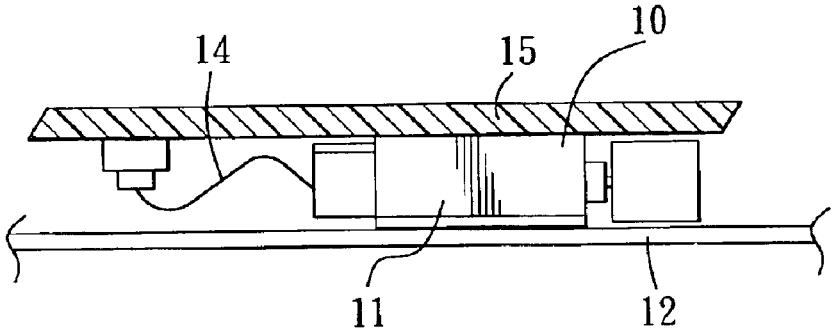
FIG. 2 PRIOR ART
FIG. 2 is a schematic view illustrating a conventional method of making electrical connection between the circuit board and the vibration module with the use of a conductive wire.
Figure 3:
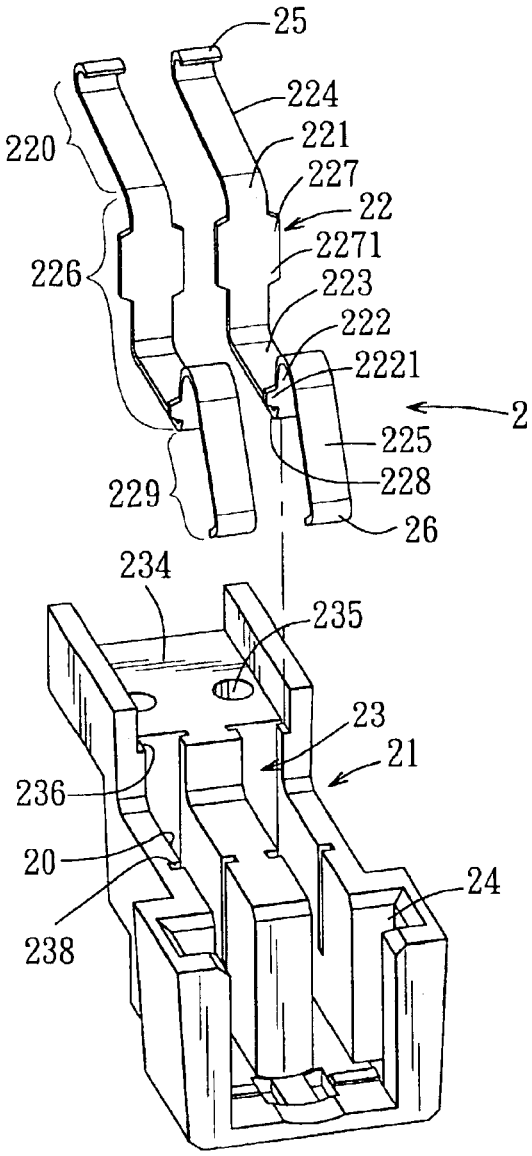
FIG. 3 is an exploded perspective view of the preferred embodiment of an electrical connector according to the present invention.
Figure 4:
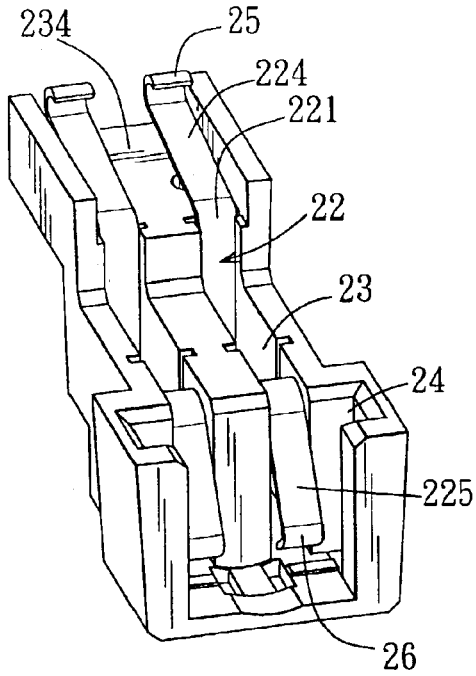
FIG. 4 is an assembled perspective view of the electrical connector of FIG. 3.

Referring to FIGS. 3 and 4, the preferred embodiment of an electrical connector 2 according to the present invention is shown to comprise a pair of conductive terminals 22 and an insulator seat 21 for receiving the conductive terminals 22.

Each conductive terminal 22 is integrally formed and has a first contact portion 220, a second contact portion 229, and a bent retaining portion 226 interconnecting the first contact portion 220 and the second contact portion 229. The retaining portion 226 is generally L-shaped and includes a vertical segment 227 formed with an upper end 221, and a horizontal segment 223 connected to the vertical segment 227 and formed with a lower end 228 that is disposed below the upper end 221. The vertical segment 227 of the retaining portion 226 has opposite lateral edges formed with a respective tab 2271. The upper end 221 of the retaining portion 226 is connected to the first contact portion 220, while the lower end 228 of the retaining portion 226 is connected to the second contact portion 229. The first contact portion 220 includes a planar segment 224 extending from the upper end 221 of the retaining portion 226 in a direction away from the second contact portion 229, and a curved segment 25 formed on one end of the planar segment 224 that is remote from the upper end 221 of the retaining portion 226. The second contact portion 229 is generally inverted U-shaped and includes a first arm segment 222 extending upwardly from the lower end 228 of the retaining portion 226, and a resilient second arm segment 225 connected to the first arm segment 222. The first arm segment 222 of the second contact portion 229 has a lateral edge formed with a tab 2221. The second arm segment 225 has an electrical contact end 26.

The insulator seat 21 is formed with a pair of upwardly opening terminal receiving cavities 23 and an engaging cavity 24 adjacent to and communicated with the terminal receiving cavities 23. Each terminal receiving cavity 23 receives the retaining portion 226 of a respective conductive terminal 22 such that the first and second contact portions 220, 229 of the respective conductive terminal 22 extend outwardly of the terminal receiving cavity 23. In this embodiment, the second arm segments 225 of the second contact portions 229 of the conductive terminals 22 extend into the engaging cavity 24. Each terminal receiving cavity 23 has a cavity-defining wall 20 formed with a pair of vertically extending slots 236 to engage the tabs 2271 on the vertical segment 227 of the retaining portion 226 of the respective conductive terminal 22, and another vertically extending slot 238 to engage the tab 2221 on the first arm segment 222 of the second contact portion 229 of the respective conductive terminal 22. Furthermore, the insulator seat 21 is formed with a support plate 234 for supporting the first contact portions 220 of the conductive terminals 22 thereon. The support plate 234 is formed with a pair of positioning holes 235.

Figure 5:
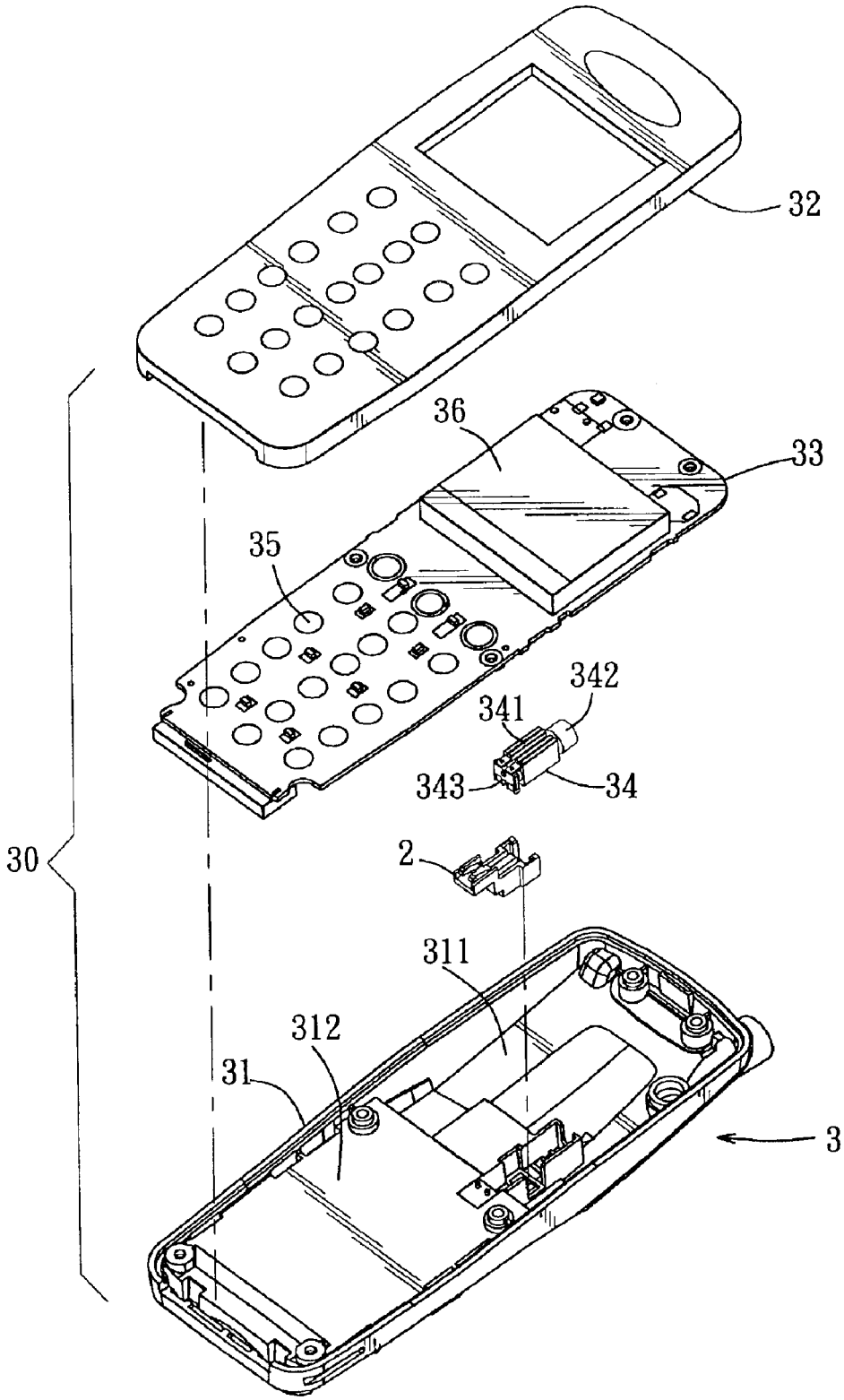
FIG. 5 is an exploded perspective view showing a mobile phone that incorporates the electrical connector of FIG. 4.

Referring to FIG. 5, the electrical connector 2 is to be installed in an electronic apparatus, such as a mobile phone 3 in this embodiment, that includes an insulator housing 30, a circuit board 33, and a vibration module 34.

The housing 30 includes an upper housing part 32 and a lower housing part 31. The lower housing part 31 has a stepped bottom wall to define a deeper portion 311 and a shallower portion 312. The height difference is designed for retaining the vibration module 34 and the electrical connector 2 underneath the circuit board 33 while maintaining the circuit board 33 flatly in the housing 30.

The circuit board 33 has a known number dialing unit, which includes a keypad 35 and an LCD display unit 36, mounted thereon.

Figure 7:
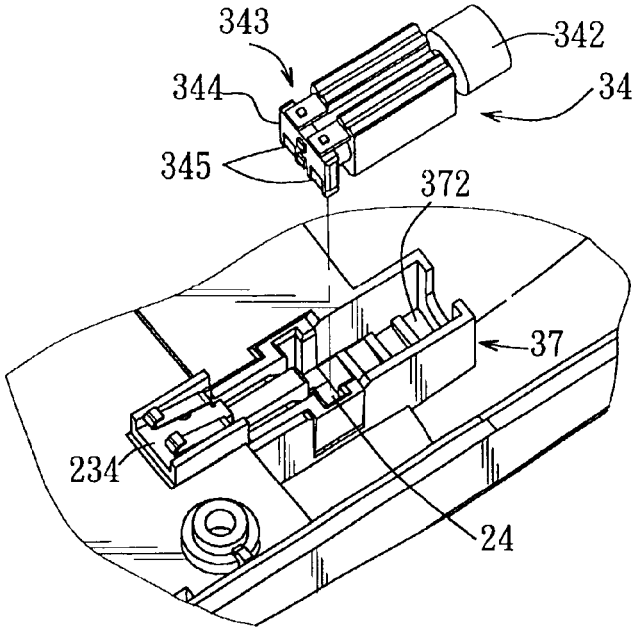
FIG. 7 is a partly exploded perspective view showing how a vibration module is mounted on the positioning seat.

The vibration module 34 is disposed under the circuit board 33 and includes a motor body 341 wrapped by a rubber sleeve, and an eccentric axle 342 driven by the motor body 341 to produce vibrations. As shown in FIG. 7, the motor body 341 has a coupling end 343 provided with an insulator block 344. Positive and negative contact terminals 345 of the motor body 341 are provided on the insulator block 344.

The electrical connector 2 is disposed under the circuit board 33 and is used to connect the vibration module 34 electrically to the circuit board 33.

Figure 6:
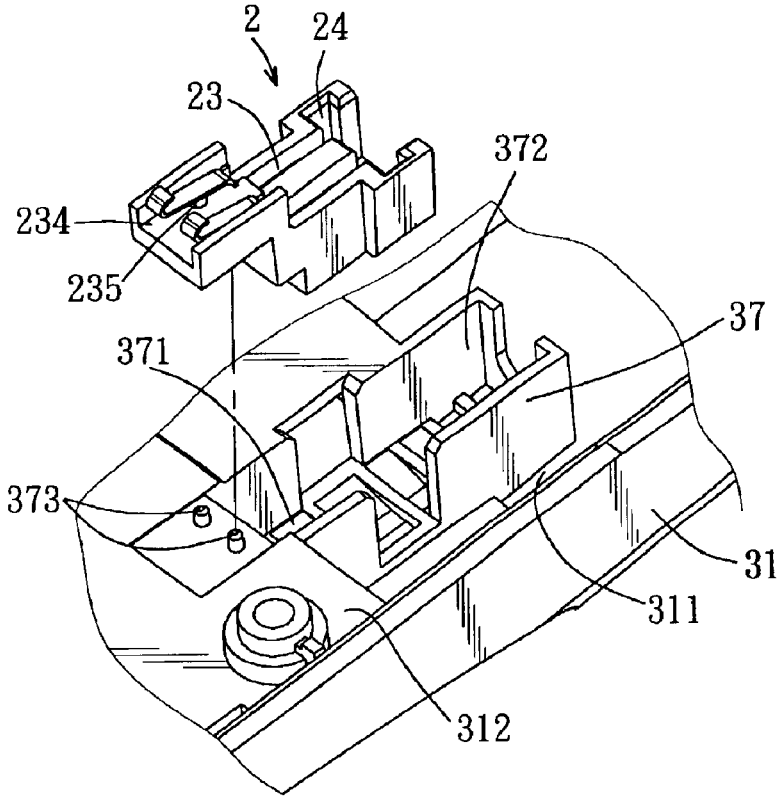
FIG. 6 is a fragmentary exploded perspective view showing how the electrical connector of the preferred embodiment is mounted on a positioning seat of a mobile phone housing.

Referring to FIG. 6, the deeper portion 311 of the lower housing part 31 is formed with a positioning seat 37 for positioning the vibration module 34 and the electrical connector 2 relative to the circuit board 33. In this embodiment, the positioning seat 37 is formed with a first positioning cavity 371 to receive the electrical connector 2, and a second positioning cavity 372 communicated with the first positioning cavity 371 to receive the vibration module 34. The shallower portion 312 of the lower housing part 31 is formed with pins 373 that cooperate with the positioning holes 235 in the support plate 234 of the insulator seat 21 of the electrical connector 2 to form a pin-and-hole engaging unit for reinforcing engagement therebetween. Particularly, when the electrical connector 2 is mounted in the first positioning cavity 371, the support plate 234 rests on the shallower portion 312 to permit engagement between the pins 373 and the positioning holes 235.

Referring to FIG. 7, when the vibration module 34 is mounted in the second positioning cavity 372, the coupling end 343 of the motor body 341 extends removably into the engaging cavity 24. As described above, the second arm segment 225 of the second contact portion 229 of each conductive terminal 22 extends into the engaging cavity 24. As such, the contact ends 26 of the conductive terminals 22 abut against the contact terminals 345 to establish electrical connection with the vibration module 34 and to position the insulator block 344 in the engaging cavity 24.

Figure 8:
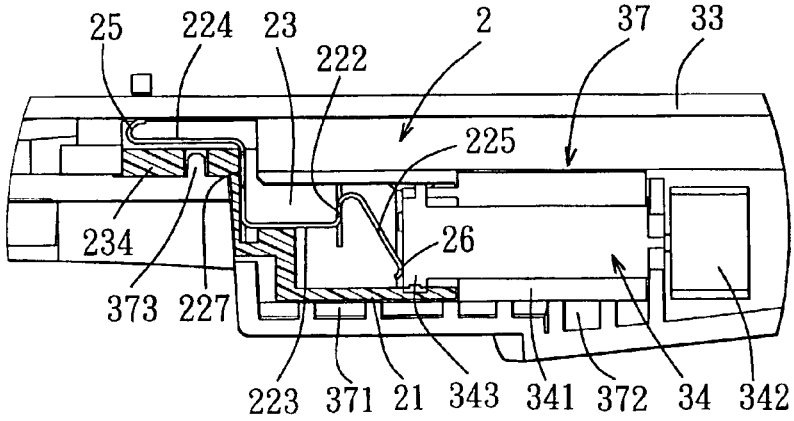
FIG. 8 is a schematic partly sectional view showing the connection among a circuit board, an electrical connector and a vibration module in the preferred embodiment of a mobile phone according to the present invention.

Referring to FIG. 8, during assembly, the electrical connector 2 is first positioned in the first positioning cavity 371. Then, the vibration module 34 is positioned in the second positioning cavity 372. At this stage, because the coupling end 343 of the motor body 341 extends into the engaging cavity 24, the vibration module 34 can be connected electrically to the conductive terminals 22 of the electrical connector 2. Then, the circuit board 33 is disposed over the electrical connector 2 such that contact points thereon are in contact with the curved segments 25 of the first contact portions 220 of the conductive terminals 22. At this time, the circuit board 33 is connected electrically to the vibration module 33 via the conductive terminals 2.

Since the positions of the planar segments 224 of the conductive terminals 22 relative to the circuit board 33 are predetermined and fixed, the curved segments 25 can be easily aligned with and can properly contact the corresponding contact points on the circuit board 33 without allocating large areas for the contact points.

It should be noted that, although the mobile phone of the preferred embodiment incorporates a numeric keypad for dialing purposes, the electronic apparatus of the present invention should not be limited thereto. The electronic apparatus of this invention can be in the form of other types of mobile phones, such as touch panel or voice-activated mobile phones, or even other kinds of communications apparatus, such as personal digital assistants (PDA). In practice, the insulator seat of the electrical connector may be formed integrally with the housing of the electronic apparatus, as long as the electrical connector can be used to connect the circuit board and the vibration module and also for firmly positioning the vibration module in the housing of the electronic apparatus.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electrical connector comprising:

an integrally formed conductive terminal having a first contact portion, a second contact portion, and a bent retaining portion with an upper end and a lower end disposed below said upper end, said upper end being connected to said first contact portion, said lower end being connected to said second contact portions, wherein said second contact portion is generally inverted U-shaped and includes a first arm segment extending upwardly from said lower end of said retaining portion, and a second arm segment connected to said first arm segment.

2. The electrical connector as claimed in claim 1, wherein said first contact portion includes a planar segment extending from said upper end of said retaining portion, and a curved segment formed on one end of said planar segment that is remote from said upper end of said retaining portion.

3. The electrical connector as claimed in claim 2, wherein said planar segment extends from said upper end of said retaining portion in a direction away from said second contact portion.

4. The electrical connector as claimed in claim 1, wherein said retaining portion is generally L-shaped and includes a vertical segment formed with said upper end, and a horizontal segment connected to said vertical segment and formed with said lower end.

5. The electrical connector as claimed in claim 4 further comprising an insulator seat formed with an upwardly opening terminal receiving cavity to receive said retaining portion of said conductive terminal such that said first and second contact portions extend outwardly of said terminal receiving cavity.

6. The electrical connector as claimed in claim 5, wherein said vertical segment of said retaining portion has a lateral edge formed with a tab, said terminal receiving cavity having a cavity-defining wall formed with a vertically extending slot to engage said tab.

7. The electrical connector as claimed in claim 5, wherein said insulator seat is formed with a support plate for supporting said first contact portion thereon.

8. The electrical connector as claimed in claim 5, wherein said insulator seat is further formed with an engaging cavity adjacent to and communicated with said terminal receiving cavity, said second arm segment of said second contact portion extending into said engaging cavity.

9. The electrical connector as claimed in claim 8, wherein said first arm segment of said second contact portion has a lateral edge formed with a tab, said terminal receiving cavity having a cavity-defining wall formed with a vertically extending slot to engage said tab.

10. An electronic apparatus comprising:

a circuit board;

a vibration module disposed under said circuit board; and an electrical connector disposed under said circuit board and adjacent to said vibration module, said electrical connector including an integrally formed conductive terminal having a first contact portion to establish electrical contact with said circuit board, a second contact portion to establish electrical contact with said vibration module, and a bent retaining portion with an upper end and a lower end disposed below said upper end, said upper end being connected to said first contact portion, said lower end being connected to said second contact portion, wherein said second contact portion is generally inverted U-shaped and includes a first arm segment that extends upwardly from said lower end of said retaining portion, and a second arm segment that is connected to said first arm segment and that serves to establish electrical contact with said vibration module.

11. The electronic apparatus as claimed in claim 10, wherein said first contact portion includes a planar segment extending from said upper end of said retaining portion, and a curved segment formed on one end of said planar segment that is remote from said upper end of said retaining portion and that serves to establish electrical contact with said circuit board.

12. The electronic apparatus as claimed in claim 11, wherein said planar segment extends from said upper end of said retaining portion in a direction away from said second contact portion.

13. The electronic apparatus as claimed in claim 10, wherein said retaining portion is generally L-shaped and includes a vertical segment formed with said upper end, and a horizontal segment connected to said vertical segment and formed with said lower end.

14. The electronic apparatus as claimed in claim 13, wherein said electrical connector further includes an insulator seat formed with an upwardly opening terminal receiving cavity to receive said retaining portion of said conductive terminal such that said first and second contact portions extend outwardly of said terminal receiving cavity.

15. The electronic apparatus as claimed in claim 14, wherein said vertical segment of said retaining portion has a lateral edge formed with a tab, said terminal receiving cavity having a cavity-defining wall formed with a vertically extending slot to engage said tab.

16. The electronic apparatus as claimed in claim 14, wherein said insulator seat is formed with a support plate for supporting said first contact portion thereon.

17. The electronic apparatus as claimed in claim 14, wherein said insulator seat is further formed with an engaging cavity adjacent to and communicated with said terminal receiving cavity, said second arm segment of said second contact portion extending into said engaging cavity, said vibration module having a coupling end extending removably into said engaging cavity to establish electrical contact with said second arm segment of said second contact portion.

18. The electronic apparatus as claimed in claim 17, wherein said first arm segment of said second contact portion has a lateral edge formed with a tab, said terminal receiving cavity having a cavity-defining wall formed with a vertically extending slot to engage said tab.

19. The electronic apparatus as claimed in claim 10, further comprising an insulator housing having said circuit board, said vibration module and said electrical connector mounted therein.

20. The electronic apparatus as claimed in claim 19, wherein said insulator housing is formed with a positioning seat for positioning said vibration module and said electrical connector relative to said circuit board.

21. The electronic apparatus as claimed in claim 20, wherein said positioning seat is formed with a first positioning cavity to receive said electrical connector, and a second positioning cavity communicated with said first positioning cavity to receive said vibration module.

22. The electronic apparatus as claimed in claim 21, wherein said electrical connector and said insulator housing are formed with a pin-and-hole engaging unit for reinforcing engagement therebetween.

23. The electronic apparatus as claimed in claim 19, further comprising a number dialing device mounted on said circuit board.

24. The electronic apparatus as claimed in claim 23, wherein said number dialing device includes a keypad and a display unit.

25. An electronic apparatus comprising:

a circuit board;

a vibration module disposed under said circuit board;

an electrical connector disposed under said circuit board and adjacent to said vibration module, said electrical connector including an integrally formed conductive terminal having a first contact portion to establish electrical contact with said circuit board, a second contact portion to establish electrical contact with said vibration module, and a bent retaining portion with an upper end and a lower end disposed below said upper end, said upper end being connected to said first contact portion, said lower end being connected to said second contact portion; and an insulator housing having said circuit board, said vibration module and said electrical connector mounted therein, said insulator housing being formed with a positioning seat for positioning said vibration module and said electrical connector relative to said circuit board;

said positioning seat being formed with a first positioning cavity to receive said electrical connector, and a second positioning cavity communicated with said first positioning cavity to receive said vibration module.

* * * * *